US010365073B1

(12) United States Patent
Foltz et al.

(10) Patent No.: US 10,365,073 B1
(45) Date of Patent: Jul. 30, 2019

(54) EXTRACTION CHARGE FOR UNDERGROUND THREATS

(71) Applicant: The United States of America as represented by the Secretary of the Navy, Washington, DC (US)

(72) Inventors: Lee Foltz, Indian Head, MD (US); Angel Diaz, Waldorf, MD (US); Dennis Askin, King George, VA (US); Herman Wallace, Dover, DE (US); Daniel McCarthy, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/732,177

(22) Filed: Sep. 29, 2017

(51) Int. Cl.

| | |
|---|---|
| ***F42B 1/028*** | (2006.01) |
| ***F42B 1/032*** | (2006.01) |
| ***F42B 3/28*** | (2006.01) |
| ***F42B 3/08*** | (2006.01) |
| ***F41H 11/12*** | (2011.01) |

(52) U.S. Cl.
CPC ..... *F42B 1/028* (2013.01); *F42B 1/032* (2013.01); *F42B 3/08* (2013.01); *F42B 3/28* (2013.01); *F41H 11/12* (2013.01)

(58) Field of Classification Search
CPC ..... F41H 11/12; F42B 1/02; B63G 7/00
USPC ..... 102/306, 307, 308, 310, 402, 403
See application file for complete search history.

(56) References Cited

U.S. PATENT DOCUMENTS

| | | | | | |
|---|---|---|---|---|---|
| 2,628,559 | A | * | 2/1953 | Jasse | F42B 1/02 102/306 |
| 3,129,665 | A | * | 4/1964 | Evans, Jr. | F42B 12/10 102/476 |
| 3,348,482 | A | * | 10/1967 | Keener | E21C 45/00 102/310 |
| 3,358,780 | A | * | 12/1967 | Venghiatts | F42B 12/18 102/308 |
| 3,750,582 | A | | 8/1973 | Kintish et al. | |
| 3,894,489 | A | * | 7/1975 | Riedl | E21B 43/117 102/308 |
| 4,004,515 | A | * | 1/1977 | Mallory | F42B 12/18 102/308 |
| 4,099,464 | A | * | 7/1978 | Cross | F42B 3/08 102/202.6 |
| 4,109,576 | A | * | 8/1978 | Eckels | F42B 1/02 102/307 |
| 4,466,353 | A | * | 8/1984 | Grace | F42B 1/02 102/307 |
| 4,942,819 | A | | 7/1990 | Thoma et al. | |
| 5,223,666 | A | | 6/1993 | Delaney, Jr. | |
| 5,247,887 | A | * | 9/1993 | Drimmer | F42B 12/16 102/308 |
| 5,370,055 | A | | 12/1994 | Fugelso et al. | |
| 5,936,184 | A | | 8/1999 | Majerus et al. | |

(Continued)

*Primary Examiner* — Bret Hayes
(74) *Attorney, Agent, or Firm* — Fredric J. Zimmerman

(57) ABSTRACT

An extraction charge for threats buried underground includes a housing, a shaped charge disposed in the housing at one end thereof, and a canister disposed in the housing and spaced apart from the shaped charge. The canister defines an open-ended tubular pathway and includes an explosive material housed in a region of the canister that circumscribes the tubular pathway. A delay detonator is coupled to the shaped charge and to the explosive material.

5 Claims, 1 Drawing Sheet

(56) References Cited

U.S. PATENT DOCUMENTS

| | | | | |
|---|---|---|---|---|
| 6,494,139 | B1 * | 12/2002 | Powell | F42B 1/02 102/310 |
| 2005/0081706 | A1 * | 4/2005 | Alford | F42B 33/062 89/1.13 |
| 2016/0186536 | A1 * | 6/2016 | Dai | E21B 43/117 175/4.57 |

* cited by examiner

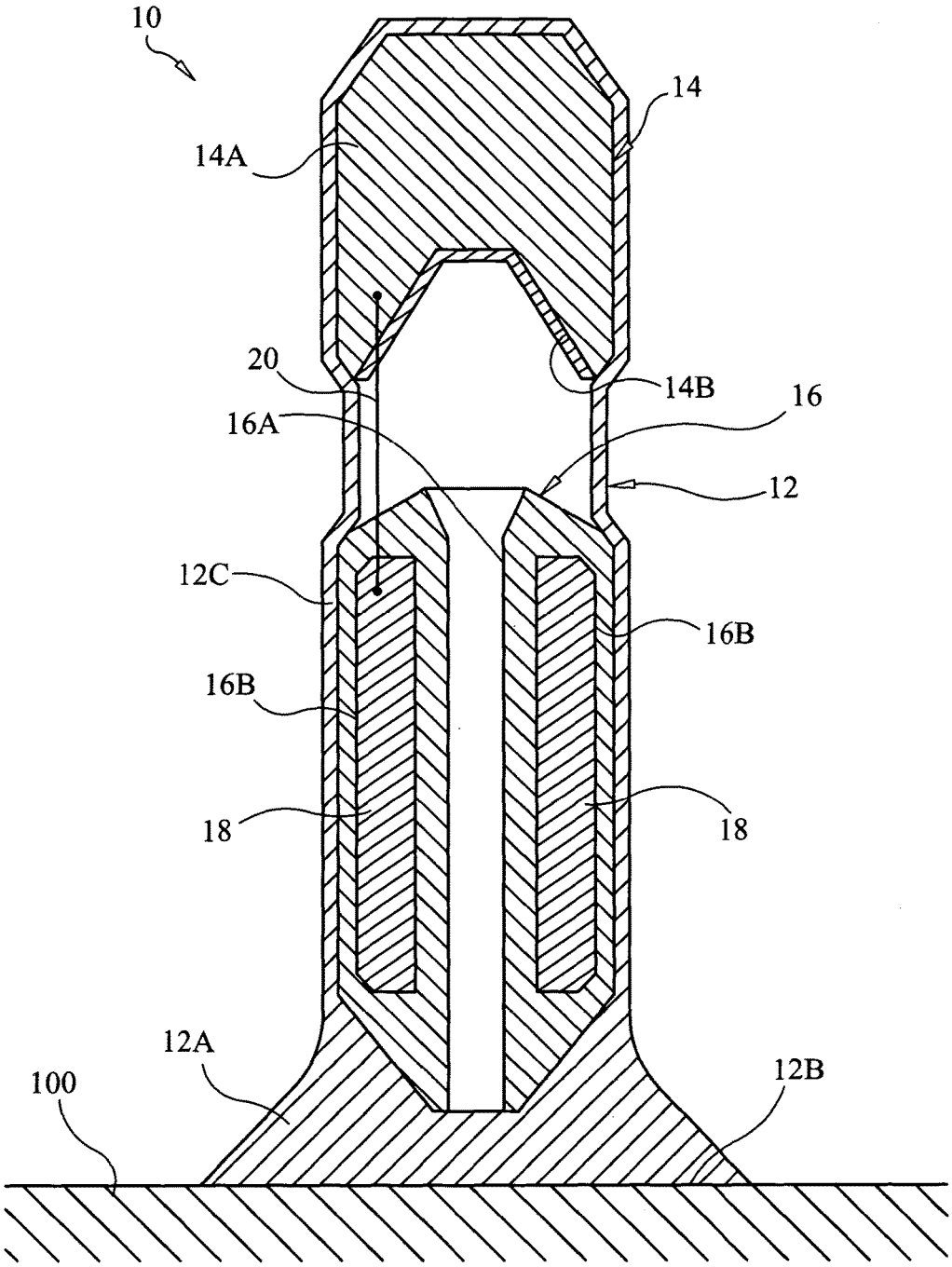
10
14
14A
20
14B
16
16A
12
12C
16B
16B
18
18
12A
12B
100

EXTRACTION CHARGE FOR UNDERGROUND THREATS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to explosive charges, and more particularly to an explosive charge assembly for extracting underground threats.

BACKGROUND OF THE INVENTION

Ordnance or other threats buried underground pose a threat to military personnel and civilians. In an effort to analyze how some underground ordnance are constructed, it is important to extract the ordnance or threat without it exploding or activated. Currently, underground threats are removed by manually digging around the threat device, and manually extracting the threat device by pulling on a line attached to the threat device.

SUMMARY OF THE INVENTION

Accordingly, it is an object of the present invention to provide an apparatus for the removal or extraction of an underground threat.

Another object of the present invention is to provide an apparatus that may be used to extract a threat buried underground without any manual digging or manual manipulation of the threat and without any sympathetic initiation of the threat.

Other objects and advantages of the present invention will become more obvious hereinafter in the specification and drawings.

In accordance with the present invention, an extraction charge for threats buried underground includes a housing and a shaped charge disposed in the housing at one end thereof. Also included is a canister disposed in the housing and spaced apart from the shaped charge. The canister defines an open-ended tubular pathway and has an explosive material housed in a region of the canister that circumscribes the tubular pathway. A delay detonator is coupled to the shaped charge and to the explosive material.

BRIEF DESCRIPTION OF THE DRAWINGS

Other objects, features and advantages of the present invention will become apparent upon reference to the following description of the exemplary embodiments and to the drawings, where corresponding reference characters indicate corresponding parts throughout the several views of the drawings and wherein:

The sole FIGURE is a cross-sectional view of an underground-threat extraction charge in accordance with an embodiment of the present invention.

DETAILED DESCRIPTION OF THE INVENTION

Referring now to the sole FIGURE, an underground-threat extraction charge is shown in cross-section and is referenced generally by numeral 10. Extraction charge 10 is designed to be placed directly on a ground surface 100 and remotely detonated. Extraction charge 10 may be fully assembled in a factory environment or configured for assembly in a field environment just prior to use without departing from the scope of the present invention.

Extraction charge 10 includes an outer housing 12 that may be a monolithic structure or an assembled structure without departing from the scope of the present invention. Housing 12 may be made from a lightweight and inexpensive material such as a plastic material. Housing 12 includes a base portion designed for stable placement on a ground setting. For example, base portion 12A may be conically shaped as shown. Base portion 12A may be solid (as shown) or hollow. Bottom 12B of housing 12 may be sealed or open without departing from the scope of the present invention. Housing 12 also includes a body portion 12C extending from base portion 12A for housing the energetic components of extraction charge 10.

Disposed in one end of body portion 12C is a shaped charge 14 that may include an explosive material 14A and a metal liner 14B (e.g., copper). Such shaped charges and materials used to construct same are well known in the art. Disposed in the other end of body portion 12C is a rigid canister 16 (e.g., made from a metal such as aluminum). Canister 16 is spaced apart from shaped charge 14 and is longitudinally aligned with shaped charge 14 in housing 12. Canister 16 defines an open-ended tubular pathway 16A centrally positioned along the longitudinal axis of canister 16. Tubular pathway 16A defines a fluid communication path between the region in body portion 12C adjacent to shaped charge 14 and base portion 12A of housing 12.

Canister 16 also defines an enclosed chamber 16B that circumscribes tubular pathway 16A. An explosive material 18 fills enclosed chamber 16B. The end 16C of canister 16 furthest from shaped charge 14 (and closest to base portion 12A) is tapered.

Explosive material 14A and explosive material 18 are coupled to one another by a delay line 20. In general, delay line 20 provides detonation energy to explosive material 18 at a time subsequent to the time explosive material 14A is detonated. Delay line 20 may be any detonation delay device, a variety of which are well-known in the art. Generally, the amount of the delay will range from approximately 250 milliseconds to approximately 500 milliseconds.

In operation, extraction charge 10 is placed on a ground location 100 with bottom 12B resting on the ground near the area of a known buried threat. Shaped charge 14 is detonated and metal liner 14B becomes a molten jet that is driven through tubular pathway 16A and bottom 12B. The molten jet bores into ground 100 to thereby form a bore hole. The explosion forces released by shaped charge 14 impinge upon canister 16 to drive canister 16 into the ground via its tapered end 16C. More specifically, canister 16 follows the molten jet into the bore hole formed by the molten jet. Delay line 20 is selected to detonate explosive material 18 after canister 16 enters the ground. In general, the explosive forces generated when explosive material 18 is detonated act on a buried threat to raise it up out of the ground. More specifically, a pressure wave moves towards a buried threat after explosive material 18 is initiated. The pressure wave includes a shock front followed by a slower particle wave that impacts the buried threat and accelerates the surrounding soil in an upward direction. Expanding gases produced from the chemical reaction of the explosive also contribute to an upward motion of the buried threat.

The advantages of the present invention are numerous. A single lightweight extraction charge makes a bore hole and drives an underground threat from the ground without any manual intervention. The extraction charge can be assembled in the field such that its handling during transport is simplified. Lightweight (e.g., on the order of 10 pounds) extraction charges applying the principles of the present invention have been constructed and have operated successfully.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

What is claimed is:

1. An extraction charge for threats buried underground, comprising:

a housing including a base and a body being coupled to said base;

a shaped charge being disposed in said body of said housing at one end thereof;

a rigid canister being disposed in said body of said housing and terminating in a tapered end adjacent to said base of said housing, said canister in longitudinal alignment with said shaped charge and spaced apart from said shaped charge, said canister defines an open-ended tubular pathway and defines an enclosed chamber circumscribing said tubular pathway;

an explosive material filling said enclosed chamber; and a delay detonator being coupled to said shaped charge and coupled to said explosive material.

2. The extraction charge as in claim 1, wherein said housing comprises a plastic material.

3. The extraction charge as in claim 1, wherein said canister comprises a metal.

4. The extraction charge as in claim 1, wherein said tubular pathway is centrally positioned in said canister.

5. The extraction charge as in claim 1, wherein said shaped charge includes a metal liner opposing said canister.

* * * * *